US012459706B2

(12) United States Patent
Petrie

(10) Patent No.: US 12,459,706 B2
(45) Date of Patent: Nov. 4, 2025

(54) CAP ASSEMBLY, A CONTAINER COMPRISING THE SAME, AND APPARATUS FOR AND METHOD OF SEALING A CONTAINER

(71) Applicant: Polar Caps Ltd., Vancouver (CA)

(72) Inventor: Christopher Allan Petrie, Vancouver (CA)

(73) Assignee: POLAR CAPS LTD., Vancouver (CA)

( * ) Notice: Subject to any disclaimer, the term of this patent is extended or adjusted under 35 U.S.C. 154(b) by 128 days.

(21) Appl. No.: 18/184,454

(22) Filed: Mar. 15, 2023

(65) Prior Publication Data

US 2023/0382602 A1 Nov. 30, 2023

Related U.S. Application Data

(60) Provisional application No. 63/346,813, filed on May 27, 2022.

(51) Int. Cl.
*B65D 41/04* (2006.01)

(52) U.S. Cl.
CPC ..... *B65D 41/0407* (2013.01)

(58) Field of Classification Search
CPC .... B65D 41/0407; B65D 41/04; B65D 81/18; B65D 55/00; B65D 47/2025; B65D 79/005
See application file for complete search history.

(56) References Cited

U.S. PATENT DOCUMENTS

| | | | | |
|---|---|---|---|---|
| 2,034,739 A | | 3/1936 | Andrew | |
| 2,971,671 A | | 2/1961 | Shakman | |
| 3,836,033 A | | 9/1974 | Podesta | |
| 3,985,255 A | | 10/1976 | Blair | |
| 4,027,776 A | | 6/1977 | Douglas | |
| 4,355,742 A | * | 10/1982 | Scholle | B65D 47/2025 222/545 |

(Continued)

FOREIGN PATENT DOCUMENTS

| | | |
|---|---|---|
| CA | 1259951 A | 9/1989 |
| EP | 0119788 A2 | 9/1984 |

(Continued)

OTHER PUBLICATIONS

Granite-Ware—4 Jar Toppers—Walmart web-page printout dated Mar. 15, 2022—https://www.walmart.ca/en/ip/graniteware-jar-toppers-red/6000196068264.

(Continued)

*Primary Examiner* — Shawn M Braden
(74) *Attorney, Agent, or Firm* — Nicholas Garner; Oyen Wiggs Green & Mutala LLP

(57) ABSTRACT

There is provided a cap assembly for a container according to one aspect. The assembly includes a cap shaped to selectively couple to a container. The cap has an aperture extending through a top thereof. The assembly includes a resilient member coupled to and spanning the aperture of the cap. The resilient member is configured to both seal the container and reversibly expand. The resilient member has a pre-loaded state in which the resilient member is outwardly concave. The resilient member is moveable from the pre-loaded state to an expanded state in which the resilient member is planar or outwardly convex.

20 Claims, 11 Drawing Sheets

(56) References Cited

U.S. PATENT DOCUMENTS

| | | | | |
|---|---|---|---|---|
| 4,574,966 | A | 3/1986 | Sandhaus | |
| 4,616,761 | A | 10/1986 | Nolan | |
| 4,815,628 | A | 3/1989 | Wehnert, III | |
| 4,873,100 | A | 10/1989 | Dirksing et al. | |
| 5,458,252 | A | 10/1995 | Logel | |
| 5,860,571 | A * | 1/1999 | Gueret | B05B 11/0027 222/153.06 |
| 6,745,912 | B2 | 6/2004 | Uehara et al. | |
| 2006/0249533 | A1 * | 11/2006 | Verespej | B65D 47/0814 222/153.01 |
| 2010/0263328 | A1 | 10/2010 | Dorsey et al. | |
| 2012/0037654 | A1 | 2/2012 | McNamara | |
| 2012/0248127 | A1 * | 10/2012 | Wurster | B65D 79/0087 220/721 |
| 2013/0119059 | A1 * | 5/2013 | Toh | B65D 51/245 220/203.11 |
| 2013/0205718 | A1 * | 8/2013 | Kapolas | B65D 79/0087 220/212 |
| 2015/0360827 | A1 | 12/2015 | Ting et al. | |
| 2016/0318686 | A1 * | 11/2016 | Russell | B65D 1/0246 |
| 2016/0376068 | A1 | 12/2016 | Kocsis | |

FOREIGN PATENT DOCUMENTS

| | | | |
|---|---|---|---|
| KR | 200318627 | Y1 | 6/2003 |
| WO | 2004009457 | A1 | 1/2004 |

OTHER PUBLICATIONS

Blossom uCap Silicone Storage Cap—Spice Ratchet web page printout dated Mar. 15, 2022—https://spiceratchet.com/product/blossom-storage-ucap.

"La Pha Pack 20 03 0059 Crimp Cap (Clear lacquered) 20 mm, Bromo-Butyl/PTFE Septa" dated Jan. 23, 2022. From the Wayback Machine: http://web.archive.org/web/20220123101820/https://distributionls.com/products/vial-crimp-cap-20mm-20030059.

* cited by examiner

CAP ASSEMBLY, A CONTAINER COMPRISING THE SAME, AND APPARATUS FOR AND METHOD OF SEALING A CONTAINER

BACKGROUND OF THE INVENTION

Field of the Invention

There is provided a cap assembly. In particular, there is provided a cap assembly for a container, a container comprising a cap assembly, an apparatus for sealing a container, and a method of sealing a container.

Description of the Related Art

United States Patent Application Publication No. 2012/0037654 A1 to McNamara discloses a container lid which seals about a peripheral lip contacting a corresponding container is disclosed. A flexible material, such as a silicone rubber, thermoplastic elastomer, or the like, is attached to at least a peripheral lip formed in a flexible substrate, such as a flexible metal or plastic material, having a first and second surface. The peripheral lip includes notches or slots to create individual sections in the lip to allow inward and outward flexing of the sections. When fitted to a container, the coated flexible substrate forms a seal between the container and the container lid. Preferably, the flexible substrate is formed in such a way that it is bi-stable, thus capable of existing in either a convex or concave state. In one embodiment of the container lid the flexible substrate includes a plurality of grasping teeth (i.e., specialized flexing sections) distributed about the periphery of the flexible substrate.

U.S. Pat. No. 5,458,252 to Logel discloses a sealing cap and container combination primarily intended for use in medical applications. The sealing cap of the preferred embodiment includes a central dome-shaped portion, annular portion, and sealing portion. In use, these portions are initially received in the mouth of the container and assume an initial concave shape with the sealing portion of the cap abutting and sealing against the inner surface of the container mouth. Thereafter, as the pressure within the container increases, the concave dome first moves toward a flattened shape and then inverts to a convex shape. As the pressure further increases, the annular portion of the cap then moves to a flattened position substantially perpendicular to the axis of the cap. During all this controlled movement, the sealing force of the cap progressively increases from an initial force to a maximum sealing force. An audible signal arrangement is also included in the design to clearly signal the user when the cap is sufficiently tightened on the container to effect an initial seal.

U.S. Pat. No. 2,971,671 to Shakman discloses a can comprising a tubular body portion. The can includes end closures mounted on the body portion. The end closures are recessed. Each of the closures comprises a continuous outer rim, a normally continuously inwardly concave central portion extending substantially across said end closure and adapted to hex outwardly to form predetermined continuously convex shapes within the confines of said recess of said closure under the influence of internal pressure within the can. The central portion has a continuous outer edge normally disposed outwardly, longitudinally of said body portion, of the other portions of said closure disposed within said rim.

U.S. Pat. No. 2,034,739 to Bodor discloses a cap for bottles and the like. The cap comprises a circular disk having an annular rim provided with outer and inner flanges. The flanges are incapable of expansion laterally yet sufficiently resilient to tenaciously grip the flange surrounding the neck at the mouth. The cap has annular corrugations in continuous reverse convolutions from centre to rim capable of expanding vertically only.

BRIEF SUMMARY OF INVENTION

There is provided, and it is an object to provide, an improved cap assembly, container, apparatus for sealing a container and method of sealing a container disclosed herein.

There is accordingly provided a cap assembly for a container according to one aspect. The assembly includes a cap shaped to selectively couple to a container. The cap has an aperture extending through a top thereof. The assembly includes a resilient member coupled to and spanning the aperture of the cap. The resilient member is configured to both seal the container and reversibly expand.

There is also provided a cap assembly for a container according to another aspect. The assembly includes a cap shaped to selectively couple to a container. The cap has an aperture extending through a top thereof. The assembly includes a resilient member coupled to and spanning the aperture of the cap. The resilient member has a pre-loaded state in which the resilient member is outwardly concave. The resilient member is moveable from the pre-loaded state to an expanded state in which the resilient member is planar or outwardly convex.

There is further provided a cap assembly for a container according to an additional aspect. The assembly includes a cap shaped to selectively couple to a container. The cap has a top and an aperture extending through the top thereof. The assembly includes a resilient member coupled to the top and spanning the aperture of the cap. The resilient member has a pre-loaded retracted position in which the resilient member extends inwards relative to the top of the cap by an angle equal to or greater than 0 degrees and equal to or less than 90 degrees relative to the top of the cap.

There is yet also provided a cap assembly for a container according to a further aspect. The assembly includes a cap shaped to selectively couple to a container. The cap has a top and an aperture extending through the top thereof. The assembly includes a resilient member coupled to the top and spanning the aperture of the cap. The resilient member has an expanded position in which the resilient member extends outwards relative to the top of the cap by an angle equal to or greater than 0 degrees and equal to or less than 180 degrees relative to the top of the cap.

There is yet further provided a cap assembly for a container according to another aspect. The assembly includes a cap shaped to selectively couple to a container. The cap has a top and an aperture extending through the top thereof. The assembly includes a resilient member coupled to the top and spanning the aperture of the cap. The resilient member has a pre-loaded retracted position in which the resilient member extends inwards relative to the top of the cap by an angle equal to or greater than 0 degrees and equal to or less than 90 degrees relative to the top of the cap. The resilient member is movable from the retracted position to an expanded position in which the resilient member extends outwards relative to the top of the cap by an angle equal to or greater than 0 degrees and equal to or less than 180 degrees relative to the top of the cap.

There is additionally provided a cap assembly for a container according to a further aspect. The assembly includes a cap shaped to selectively couple to a container. The cap spans a volume and has an aperture extending through a top thereof. The assembly includes a resilient member coupled to and spanning the aperture of the cap. The resilient member is selectively expandable inwards or outwards relative to the top of the cap so as to span a volume equal to or less than half the volume spanned by the cap.

There is yet also provided a cap assembly for a container according to an additional aspect. The assembly includes a cap shaped to selectively couple to a container. The cap has an aperture extending through a top thereof. The assembly includes a resilient member coupled to and spanning the aperture of the cap. The resilient member is selectively retractable inwards relative to the top of the cap so as to reduce the effective combined volume enclosed by the cap and the resilient member by up to 50% thereof.

There is further provided a cap assembly for a container according to another aspect. The assembly includes a cap shaped to selectively couple to a container. The cap has an aperture extending through a top thereof. The assembly includes a resilient member coupled to and spanning the aperture of the cap. The resilient member is selectively extendable outwards relative to the top of the cap so as to expand the effective combined volume enclosed by the cap and the resilient member by up to 50% thereof.

There is additionally provided a cap assembly for a container according to a further aspect. The assembly includes a cap shaped to selectively couple to a container. The cap spans a volume and has an aperture extending through a top thereof. The assembly includes a resilient member coupled to and spanning the aperture of the cap. The resilient member is selectively expandable relative to the top of the cap so as to change the effective combined volume enclosed by the cap and the resilient member by anywhere in the range up of reduced by 50% thereof to expanded by 50% thereof.

There is also provided a cap assembly for a container according to another aspect. The assembly includes a cap shaped to selectively couple to a container. The assembly includes a resilient member coupled to the cap. The cap is shaped to exert a clamping force about an outer peripheral portion of the resilient member in a first direction to bias the outer peripheral portion of the resilient member against an outer rim of the container. The cap is shaped to enable a central portion of the resilient member to selectively expand in the first direction or a second direction opposite the first direction, upon one or more forces acting upon the resilient member.

There is further provided a cap assembly for a container according to another aspect. The cap assembly includes a cap having an open-top. The cap assembly includes a sealing member coupled to and spanning the open-top of the cap. The cap in use functions to bias an outer peripheral portion of the sealing member downwards or against the container while enabling a central portion of the sealing member to reversibly stretch inwards and outwards relative to the open-top of the cap.

There is additionally provided a container sealing assembly. The assembly includes a housing has an aperture extending through. The assembly includes a resilient member coupled to and spanning the aperture of the housing. The resilient member has a pre-loaded state in which the resilient member is outwardly concave. The resilient member is moveable from the pre-loaded state to an expanded state in which the resilient member is planar or outwardly convex.

There is further provided a cap assembly for a container according to another aspect. The cap assembly includes a cap shaped to selectively couple to a container. The cap has an aperture extending through a top thereof. The cap assembly includes an elastomer coupled to and spanning the aperture of the cap. The elastomer is configured to readily and reversibly stretch so as to inhibit an increase in internal pressure within the container as water-containing contents therewithin begin to freeze.

There is also provided a container comprising one or more of the above referred to assemblies.

There is further provided a container according to another aspect. The container includes a hollow body with an open top. The container includes a cap shaped to selectively couple to the open top of the body. The cap has an aperture extending therethrough. The container includes a resilient member coupled to and spanning the aperture of the cap. The resilient member is pre-loaded to a retracted position in which the resilient member is outwardly concave when the cap couples to the hollow body. Freezing contents of the container causes the resilient member to expand from the retracted position to a planar or expanded position in which the resilient member is planar or outwardly convex. Removing the cap causes the resilient member to move towards the planar position. Re-coupling the cap to the body while pre-loading the resilient member once more enables the resilient member to be outwardly concave once more.

There is yet further provided an apparatus for sealing a container according to one aspect. The apparatus includes a gripping member shaped to selectively couple to a cap. The gripping member includes a protrusion shaped to bias a top of the cap towards a bottom of the cap. The gripping member includes an actuator which selectively rotates one of the gripping member and a container. The actuator so configured functions to cause the cap so gripped to threadably couple to the container.

There is also provided a method of sealing a container. The method includes providing a cap with an aperture and a resilient member coupling to the cap and spanning the aperture. The method includes pre-loading the resilient member by pushing downwards on the resilient member. The method includes coupling the cap with the resilient member so pre-loaded, to the container.

There is yet also provided a method of manufacturing of a liquid-filled and sealed container according to one aspect. The method includes providing the container with an opening. The method includes at least partially filling the container with a liquid via the opening. The method includes forming a cap with an aperture extending through a top therethrough. The method includes coupling a resilient member to the cap so as to span across or adjacent to the aperture of the cap. The method includes depressing the resilient member inwards. The method includes coupling the cap with the resilient member so depressed, to the container so as to seal the opening of the container via the resilient member.

There is additionally provided a method of manufacturing of a liquid-filled and sealed container according to another aspect. The method includes providing a container with an opening. The method includes at least partially filling the container with a liquid via the opening. The method includes positioning a resilient member to span across or adjacent to the aperture of the container. The method includes depressing the resilient member inwards. The method includes coupling the resilient member so depressed, to the container so as to seal the opening of the container via the resilient member.

It is emphasized that the invention relates to all combinations of the above features, even if these are rectified in different claims.

Further aspects and example embodiments are illustrated in the accompanying drawings and/or described in the following description.

BRIEF DESCRIPTION OF DRAWINGS

The accompanying drawings illustrate non-limiting example embodiments of the invention.

DESCRIPTION OF THE PREFERRED EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 6:
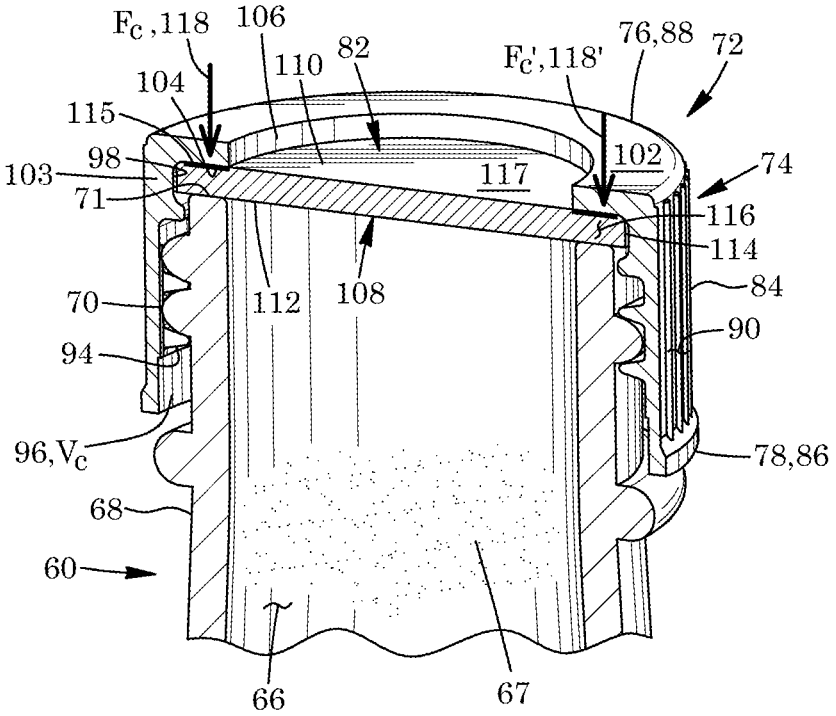
FIG. 6 is a front, top perspective sectional view of the cap assembly of FIG. 5 shown in segment and shown threadably coupled to an open end of a bottle, with the bottle being shown in fragment.
Figure 7:
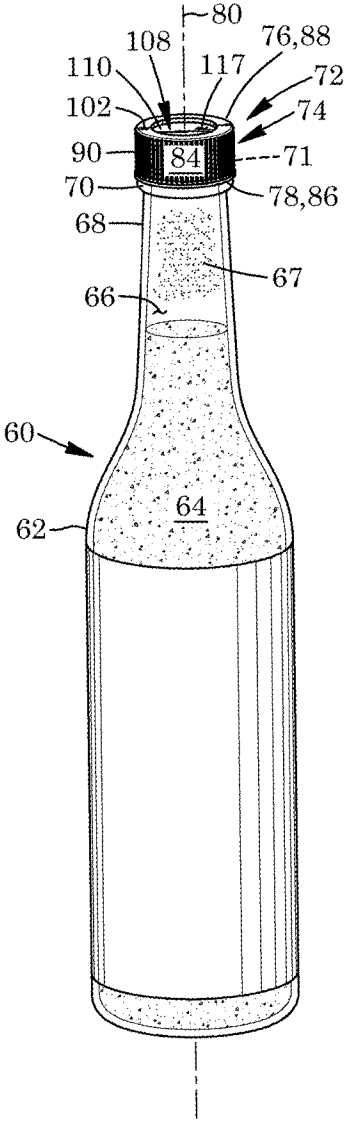
FIG. 7 is a front, top perspective view of the bottle and cap assembly of FIG. 6, with the cap assembly shown coupled to the bottle and including a resilient member shown in a planar position.

Referring to the drawings and first to FIG. 7, there is shown a container, in this example a bottle 60. However, a container in the form of a bottle is not strictly required and other types of containers may be provided in other embodiments. Bottle 60 is made of glass 61 in this example; however, here too this is not strictly required. The bottle includes a hollow body 62 shaped to receive and store contents therein: in this example water-containing contents, in this case a water-containing liquid 64 positioned within interior 66 of the bottle. The liquid in this example comprises or includes at least in part water or other such liquids which may have an altered volume upon freezing and/or upon being subjected to a significant change in temperature. Referring to FIG. 6, bottle 60 in this non-limiting embodiment includes a neck portion 68 and exterior threading 70 extending about the neck portion thereof. The bottle has a mouth, outer rim or open top 71 adjacent the threading thereof and in fluid communication with interior 66 thereof.

Containers including bottles per se are well known to those skilled in the art and bottle 60 will thus not be described in further detail.

Figure 2:
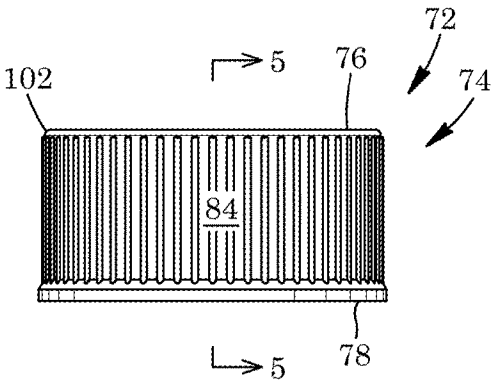
FIG. 2 is a front elevation view thereof, with the rear elevation view of the cap assembly being a mirror thereof.
Figure 4:
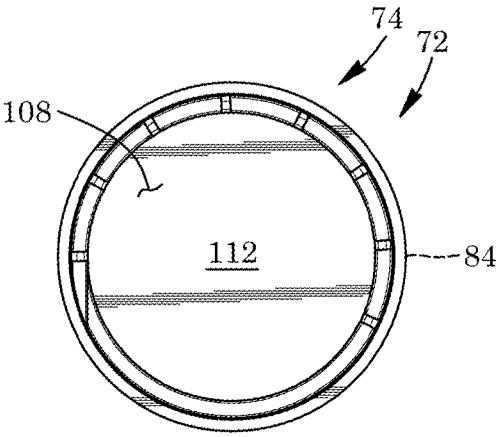
FIG. 4 is a bottom plan view thereof.
Figure 1:
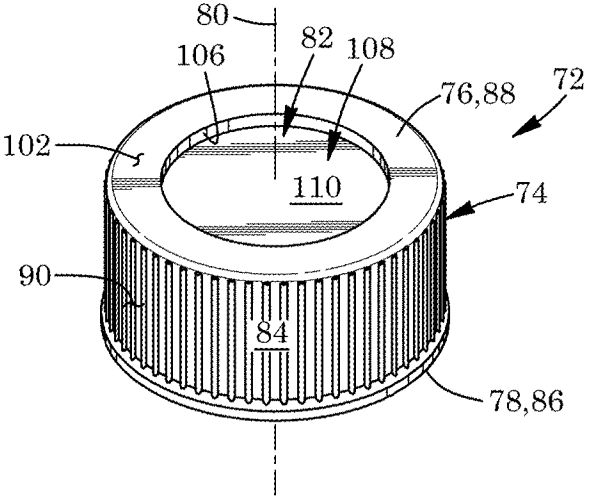
FIG. 1 is a top, front perspective view of a cap assembly according to one aspect.
Figure 3:
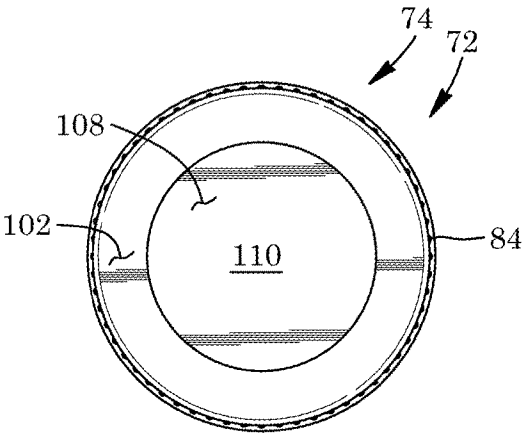
FIG. 3 is a top plan view thereof.

As seen in FIG. 1, there is shown a cap assembly 72 for the bottle. The cap assembly includes a housing or cap 74. The cap is rigid or semi-rigid in this non-limiting embodiment. Cap 74 is in this example made of a thermoplastic, in this case a hard plastic; however, this is not strictly required and the cap may be made of other materials in other examples. The cap has a top 76 that is open when not coupled to other components of cap assembly 72. In addition or alternatively, the top of cap 74 may be referred to as recessed. The cap has an open bottom 78 spaced-apart from the top thereof and a longitudinal axis 80 that extends from the top to the bottom thereof. As seen in FIG. 6, cap 74 spans a volume $V_C$ extending from bottom 78 to top 76 thereof. Referring back to FIG. 1, the cap has an aperture 82 that is centrally positioned in this example and circular; however, this is not strictly required. The aperture of cap 74 extends through top 76 of the cap.

Figure 5:
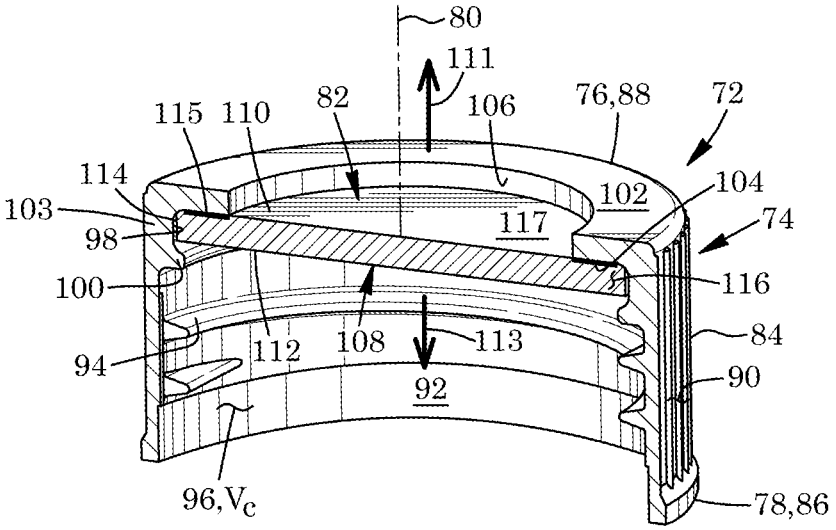
FIG. 5 is a front, top perspective sectional view taken along lines 5-5 of the cap assembly of FIG. 2.

The cap includes a sleeve or skirt 84 that extends from bottom 78 to top 76 thereof. The skirt has a first or proximal end 86 aligned with the bottom of the cap and a second or distal end 88 aligned with the top of the cap and spaced-apart from the proximal end thereof. Skirt 84 has an exterior surface 90 extending between the ends thereof. The exterior surface of the skirt in this non-limiting embodiment is shaped to promote gripping thereof: in this example the exterior surface is corrugated, though this is not strictly required. As seen in FIG. 5, skirt 84 has an interior surface 92 along which extends threading 94 between ends 86 and 88 thereof. As seen in FIG. 6, cap 74 is shaped to selectively threadably couple to open top 71 of bottle 60 via threading 70 and 94.

Referring to FIG. 5, the cap has an interior 96 about which skirt 84 extends. Cap 74 includes a receptacle or mount, in this example a radially-inwardly facing passageway 98. The passageway is annular in this example. Passageway 98 is in fluid communication with interior 96 of cap 74. The passageway is C-shaped in lateral section in this example. Passageway 98 is adjacent to the open top of the cap in this embodiment. The passageway couples to interior surface 92 of skirt 84 in this example.

Still referring to FIG. 5, cap 74 includes a flange 102 that is annular in this example. As seen in FIG. 1, the flange of the cap couples to and extends radially inwards from distal end 88 of skirt 84 of the cap in this example towards longitudinal axis 80 of the cap. Flange 102 of cap 74 aligns along and is coplanar with top 76 of the cap in this example. As seen in FIG. 5, passageway 98 may be formed by the flange of the cap, an upper thread 100 of threading 94 adjacent to the open top of the cap and a portion 103 of skirt 90 extending therebetween; however, this is not strictly required.

Still referring to FIG. 5, flange 102 of cap 74 has an interior surface 104 that is annular. The interior surface of the flange of the cap faces bottom 78 of the cap in this example. Referring to FIG. 1, flange 102 of cap 74 has an inner edge portion 106. The inner edge portion of flange 102 is circular in top and bottom profile in this example. Inner edge portion 106 of the flange is radially-inwardly facing and faces longitudinal axis 80 of the cap in this example.

As seen in FIG. 5, the cap assembly includes a resilient member 108. The resilient member is stretchable and elastic and may be referred to as a sealing member. Resilient member 108 is made of a material more flexible than that of cap 74. The resilient member is in this example an elastomeric material and may be referred to as an elastomer; however, this is not strictly required and the resilient member may be made of other types of elastic and/or resilient materials in other examples. Resilient member 108 is configured to be substantially planar in a non-stretched/non-expanded state in this example. The resilient member has a top 110 and a bottom 112 spaced-apart from the top thereof. The top and bottom of resilient member 108 extend laterally relative to axis 80 when the resilient member in its non-stretched/non-expanded state. Top 110 and bottom 112 of the resilient member are circular in this non-limiting embodiment. Resilient member 108 includes an outer edge portion 114 that is annular in this example and that extends between the top and bottom thereof. The outer edge portion of the resilient member extends parallel to longitudinal axis 80 of cap 74 in this case.

Resilient member 108 includes an outer peripheral portion 116 that extends from outer edge portion 114 thereof radially inwards towards the longitudinal axis of the cap. The outer peripheral portion of the resilient member couples to and is integrally connected to the outer edge portion of the resilient member so as to form a unitary whole in this example. Outer peripheral portion 116 of resilient member 108 is annular in this example. The outer peripheral portion of the resilient member is planar. As seen in FIG. 5, outer peripheral portion 116 of resilient member 108 couples to cap 74 in this example. In this example, passageway 98 of the cap is shaped to receive the outer peripheral portion of the resilient member. Cap 74 extends about and encloses outer edge portion 114 of resilient member 108 and encloses top 110 of resilient member 108 at least in part. The cap may thus be said to enclose the sides and top of outer peripheral portion 116 of the resilient member in this example. Cap 74, with its passageway 98 and flange 102 so shaped, is configured to inhibit resilient member 108 from expanding radially outwards while enabling the resilient member to expand axially either upwards (as shown by arrow 111) or downwards (as shown by arrow 113) relative to top 76 thereof and from the perspective of FIG. 5.

Flange 102 of cap 74 overlaps with outer peripheral portion 116 of resilient member 108 in this example. In this case interior surface 104 of the flange couples to the outer peripheral portion of the resilient member, in this example via bonding 115 or molding. However, this is not strictly required and flange 102 and outer peripheral portion 114 of resilient member 108 may couple together via an interference and/or friction fit in another example. As a further non-limiting alternative, the resilient member may couple to cap 74 solely via passageway 98 receiving and holding in place the resilient member.

Resilient member 108 has a central portion 117 about which outer peripheral portion 114 extends. The central portion of the resilient member is circular and planar in the non-stretched/non-expanded state in this example. Central portion 117 of resilient member 108 extends inwards from inner edge portion 106 of flange 102 of cap 74 to longitudinal axis 80 of cap 74.

As seen in FIG. 5, the resilient member is shaped to span the extent of aperture 82 of the cap. Resilient member 108 is continuous and shaped to inhibit fluid from passing therethrough. Referring to FIG. 6, the resilient member is so shaped and coupled to cap 74 so as to inhibit fluid communication between aperture 82 and interior 66 of bottle 60. The resilient member in this example extends adjacent to top 76 of cap 74 and the top of the cap may thus be said to be resilient. Resilient member 108 effectively closes the top of the cap and the cap may thus be referred to as having a closed top in this sense.

As seen in FIG. 6, outer peripheral portion 116 of the resilient member is shaped to extend along open top 71 of bottle 60. Cap 74 so threadably coupled to bottle 60, is shaped to exert a clamping force Fc/Fc' about outer peripheral portion 116 of resilient member 108 in a first direction 118/118' to bias the outer peripheral portion of the resilient member against the open top of the bottle. In this example, flange 102 of cap 74 is shaped to bias the outer peripheral portion of resilient member 108 against the bottle to promote sealing of the bottle. Cap assembly 72 is configured such that clamping force Fc/Fc' is adjustable based on and/or proportional to the extent to which flange 102 of cap 74 is moved towards the bottle (as shown by arrow 129) via threadably coupling to the bottle. The cap assembly is thus configured to selectively couple/clamp resilient member 108 to the bottle so as to seal the bottle and in a secure manner which also enables central portion 117 of the resilient member to stretch/retract and move freely.

As seen in FIG. 7, the resilient member has a non-stretched/non-expanded, intermediate or planar position in which the resilient member is planar including the central portion 117 thereof. As seen in FIG. 5, cap 74 is shaped to inhibit puncturing of resilient member 108 when the resilient member is in the planar position. In this example, outer peripheral portion 116 of the resilient member is enclosed by passageway 98 and flange 102 of the cap and central portion 117 of the resilient member is recessed or inwardly spaced from top 76 of the cap.

Figure 9:
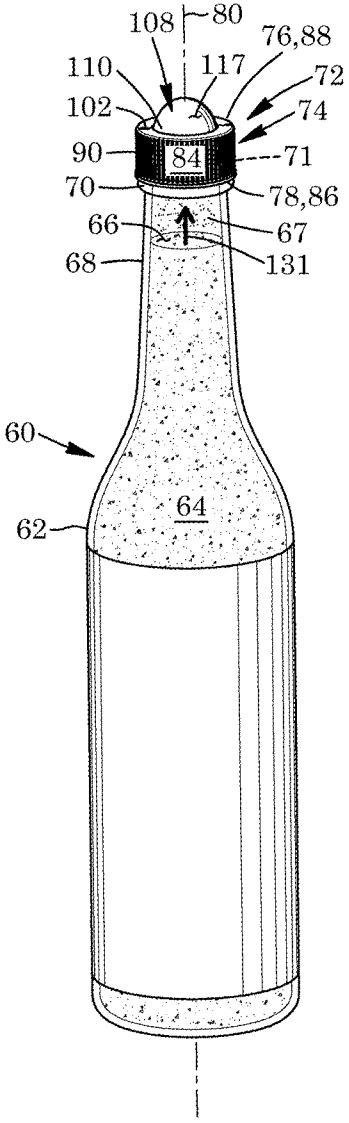
FIG. 9 is a front, top perspective view of the bottle and cap assembly of FIG. 8, with contents of the bottle being shown fully frozen and with the resilient member of the cap assembly shown in a more expanded position in which the resilient member is outwardly convex and yet more enlarged.
Figure 8:
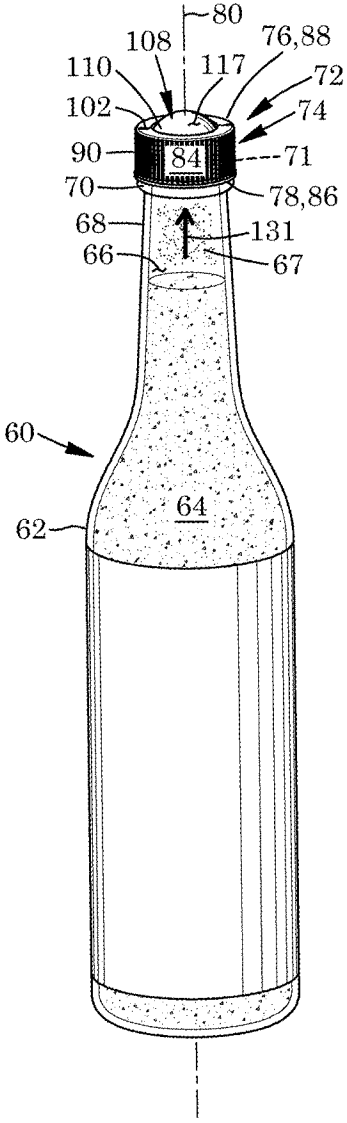
FIG. 8 is a front, top perspective view of the bottle and cap assembly of FIG. 7, with contents of the bottle being shown in the process of expanding due to freezing and with the resilient member of the cap assembly shown in a partially expanded position in which the resilient member is outwardly convex and enlarged.

Referring to FIGS. 7 to 9, as temperatures reach the freezing point of liquid 64 within bottle 60 (such as zero degrees Celsius for most foodstuff liquids which include water), the liquid within the bottle may expand as seen in FIGS. 8 and 9. This functions to increase internal pressure on the bottle including glass 61 as shown by arrow 131. Central portion 117 of resilient member 108 is shaped to expand upon water contents within bottle 60 freezing. The resilient member is thus shaped to accommodate an expansion of volume within the bottle arising from the freezing of liquid 64 within the bottle. In this example resilient member 108 has extended/expanded positions seen in FIGS. 8 and 9 in which central portion 117 of the resilient member is outwardly convex. The resilient member expands with liquid 64, with the resilient member easing internal pressure within bottle 60 thereby. Cap assembly 72 as herein described may thus inhibit the bottle from breaking and/or getting damaged and/or may function to inhibit spoiling of and/or damage to the interior contents or foodstuff of the bottle.

Figure 16:
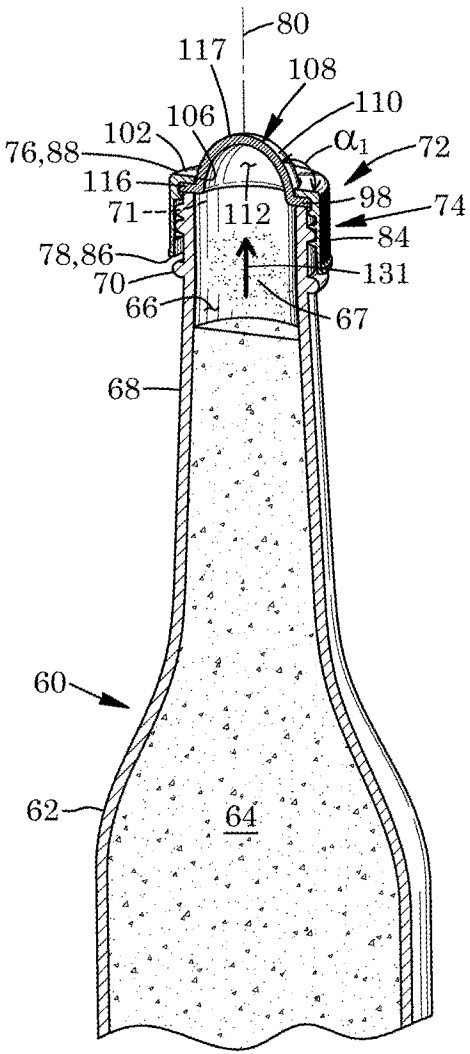
FIG. 16 is a front, top perspective sectional view of the bottle and cap assembly of FIG. 15, with contents of the bottle being shown fully frozen and with the resilient member of the cap assembly shown in the more expanded position in which the resilient member of is outwardly convex.

As seen in FIG. 16, resilient member 108 in the expanded position extends outwards relative to top 76 of cap 74 by an angle $\alpha_1$ equal to or greater than 0 degrees and equal to or less than 180 degrees relative to the top and in this case flange 102 of the cap. Angle $\alpha_1$ is obtuse in the state/embodiment shown in FIG. 16.

In addition or alternatively, resilient member 108 may be outwardly bulbous in shape in the expanded position thereof. The resilient member in this embodiment/state thus extends outwards relative to top 76 of cap 74 by an angle $\alpha_2$ equal to or greater than 0 degrees and equal to or less than 90 degrees. Angle $\alpha_2$ may thus be acute in the embodiment/state shown in FIG. 17. Central portion 117 of resilient member 108 is selectively extendable outwards relative to top 76 of cap 74 so as to expand the effective combined volume enclosed by the cap and the resilient member by up to 50% thereof in this example.

Figure 15:
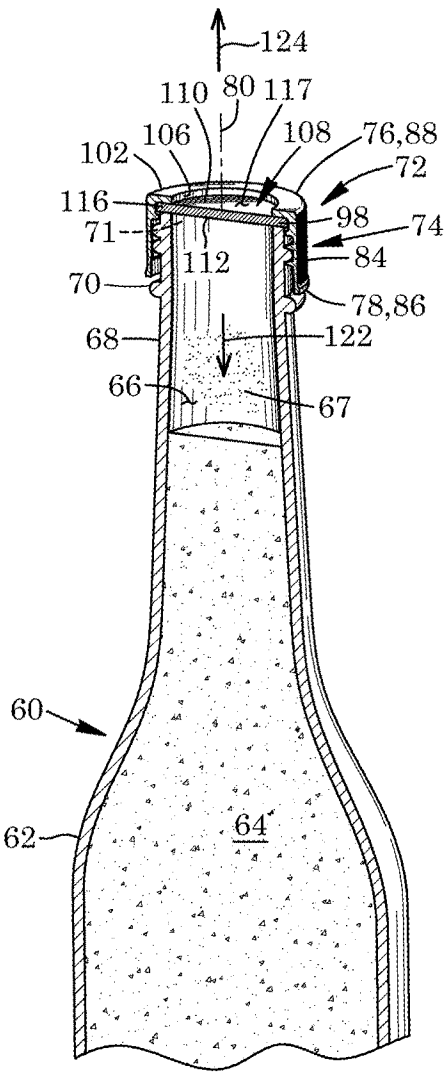
FIG. 15 is a front, top perspective sectional view of the bottle and cap assembly of FIG. 10, with contents of the bottle being shown in the process of expanding due to freezing and with the resilient member of the cap assembly shown in the planar position (instead of the retracted position of FIG. 10) as a result thereof.
Figure 19:
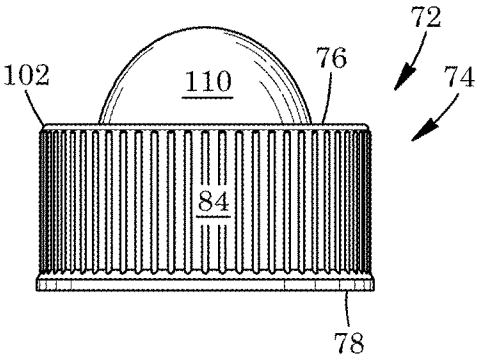
FIG. 19 is a front elevation view thereof, with the rear elevation view of the cap assembly being a mirror image thereof.
Figure 21:
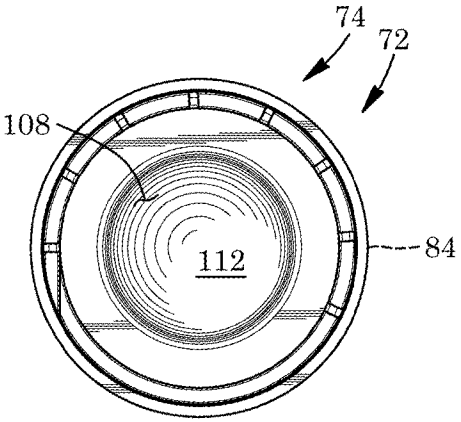
FIG. 21 is a bottom plan view thereof.
Figure 18:
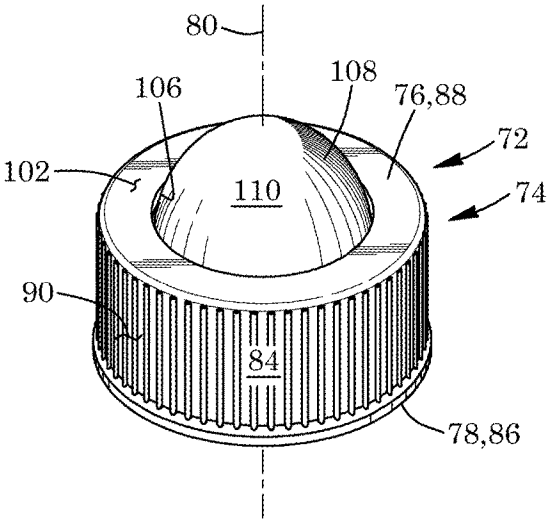
FIG. 18 is a front, top perspective view of the cap assembly of FIG. 16 in the more expanded position thereof.
Figure 20:
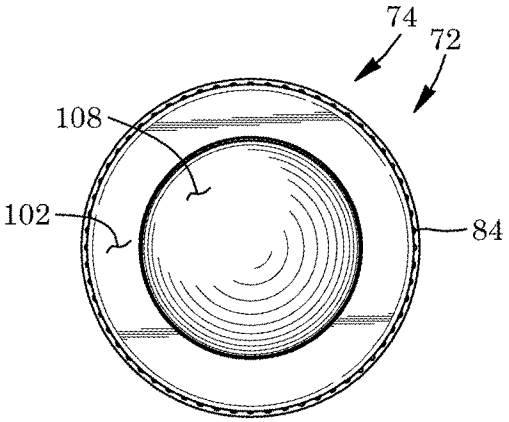
FIG. 20 is a top plan view thereof.

Removing or unthreading cap 74 from bottle 60 causes and/or enables central portion 117 of resilient member 108 to move/bias towards the planar position of the resilient member once more as seen in FIG. 15. Re-coupling the cap to bottle 60 thereafter enables the central portion of the resilient member to be in the planar position once more. This may enable the cap to expand yet further to accommodate additional expansion of the contents within the bottle: for example, the cap in a first expanded state may be removed from the bottle in which a portion of the liquid has become partially frozen, with the cap next re-coupling to the bottle with the resilient member extending within a planar position, and the cap moving to a second extended state in response to a greater portion of the liquid becoming frozen.

Figure 10:
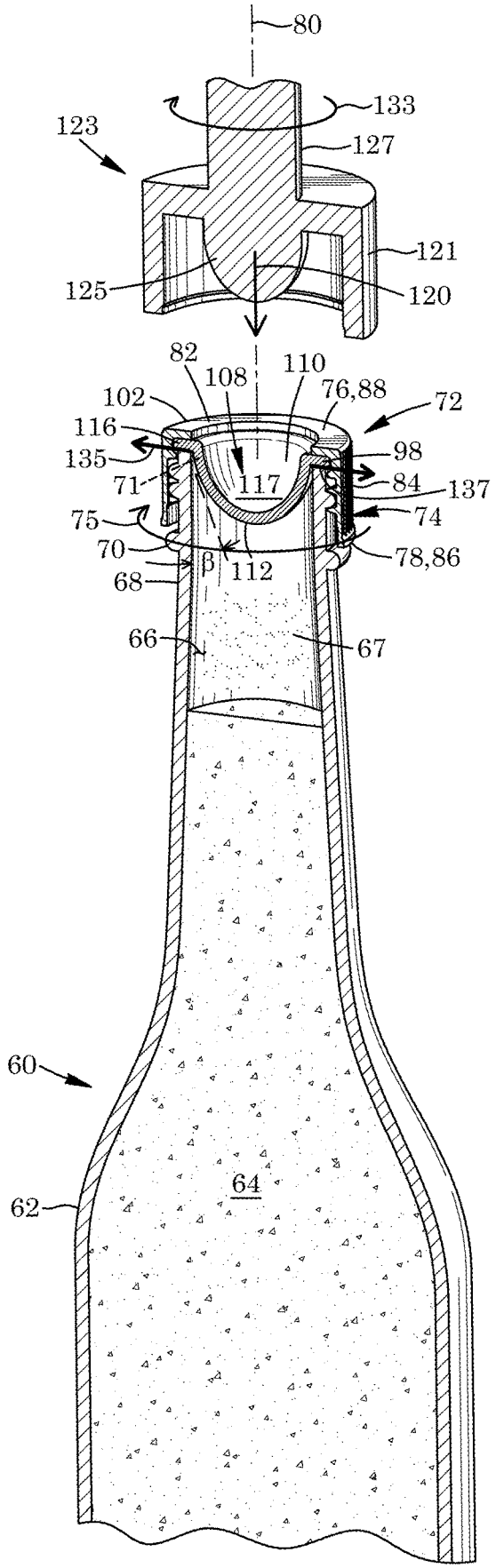
FIG. 10 is a front, top perspective sectional view of the bottle and cap assembly of FIG. 7, with the resilient member of the cap assembly being shown in the process of being pre-loaded and inwardly depressed towards a retracted position as the cap assembly is in the process of coupling to the bottle.
Figure 11:
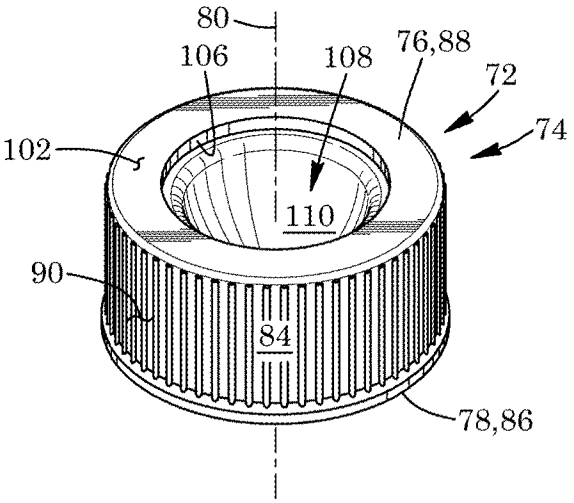
FIG. 11 is a front, top perspective view of the cap assembly of FIG. 10 so pre-loaded and in the retracted position.
Figure 12:
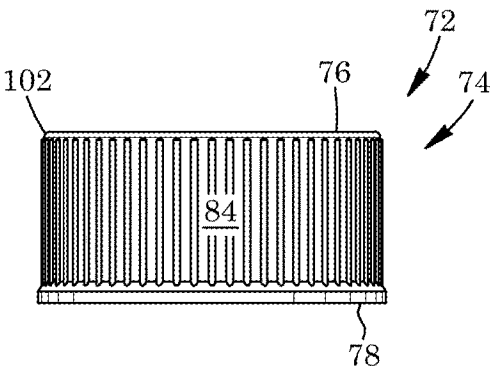
FIG. 12 is a front elevation view thereof, with the rear elevation view of the cap assembly being a mirror image thereof.
Figure 13:
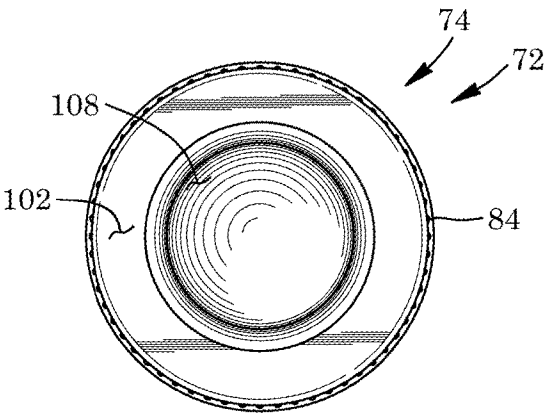
FIG. 13 is a top plan view thereof.
Figure 14:
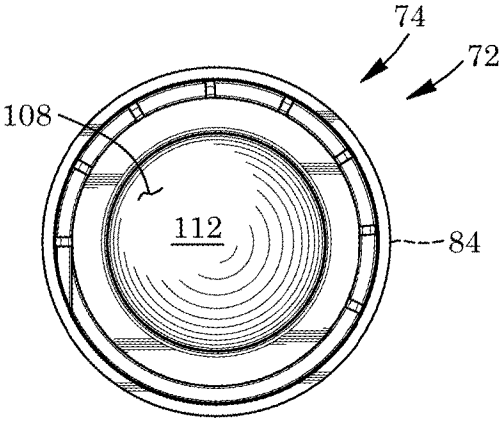
FIG. 14 is a bottom plan view thereof.

Referring to FIG. 10, cap assembly 72 is configured to enable resilient member 108 to be pre-loaded while cap 74 threadably couples to bottle 60 as seen by arrow 75. The resilient member is outwardly concave in the pre-loaded state, non-stretched/non-expanded state or retracted position seen in FIG. 10. The process of pre-loading cap 74 may function to reduce the amount of gas, in this example air 67, within bottle 60 and/or create a partial vacuum within interior 66 of bottle 60.

Resilient member 108 may thus be mechanically depressed or pressed downwards, in this non-limiting embodiment via a protrusion 125 before the cap is sealed, thereby increasing the amount of expansion volume cap assembly 72 can accommodate. The protrusion in this non-limiting embodiment may be a part of a gripping member 121, though this is not strictly required. The gripping member is shaped to selectively couple to cap 74 via any suitable means such as a suction or mechanical means. Centrally-positioned protrusion 125 of gripping member 121 is shaped to bias central portion 117 of resilient member 108 of cap assembly 72 towards bottom 78 of cap 74. To pre-load the cap assembly, the resilient member is inwardly biased in a direction parallel to longitudinal axis 80, as seen by arrow 120, towards bottom 78 of cap 74 while the cap couples to bottle 60 to reduce the amount of 67 air within the bottle.

Gripping member 121 in this non-limiting embodiment is a part of an apparatus 123 for sealing bottle 60. The apparatus in this example includes an actuator 127 that selectively rotates one of gripping member 121 and bottle 60, in this example the gripping member as shown by arrow 133. The actuator so configured functions to cause cap 74 so gripped to threadably couple to bottle 60. This is not strictly required and other mechanisms for threadably coupling the cap to the bottle may be used in other embodiments. Gripping member 121 is shaped to pre-load central portion 117 of resilient member 108 such that pressure within bottle 60 is reduced upon or after the cap has sealably coupled to the bottle. The reduced pressure within the bottle promotes retraction of the resilient member at least partially within the bottle. Gripping member 121 and/or protrusion 125 thereof are shaped to cause central portion 117 of resilient member 108 to bias towards an outwardly concave shape after cap 74 so couples to bottle 60.

Central portion 117 of resilient member 108 thus extends towards the bottom of the cap in the retracted position. Cap 74 is shaped to inhibit puncturing of the resilient member when the resilient member is in the retracted position. Central portion 117 of resilient member 108 extends inwards from and away from top 76 of cap 74. The central portion of the resilient member so positioned is thus yet further enclosed and protected by skirt 84 of the cap.

Resilient member 108 in the retracted position seen in FIG. 10 extends inwards relative to top 76 and flange 102 of cap 74 by an angle β equal to or greater than 0 degrees and equal to or less than 90 degrees relative to the top and flange of the cap. Angle β may be acute in one embodiment. Resilient member 108 may be inwardly bulbous in the retracted position thereof. The resilient member is selectively retractable inwards relative to top 76 and flange 102 of cap 74 so as to reduce the effective combined volume enclosed by the cap and the resilient member by up to 50% thereof in this example.

Resilient member 108 is positioned between top 76 and bottom 78 of cap 74 in a non-stretched/non-expanded state, in this example in the retracted position seen in FIG. 10 or planar position seen in FIG. 15. The resilient member is flush with the top of the cap in the retracted and planar positions. Central portion 117 of resilient member 108 is inwardly spaced from top 76 of cap 74 in the retracted and planar positions seen in FIGS. 10 and 15.

Referring to FIG. 15, cap 74 is thus shaped to enable central portion 117 of resilient member 108 to selectively expand in a first or inward direction 122 or a second or outward direction 124 opposite the first direction, upon one or more forces acting upon the resilient member. Resilient member 108 is thus moveable from the pre-loaded state seen in FIG. 10 to an expanded state in which central portion 117 of the resilient member is planar as seen in FIG. 15, or outwardly convex as seen in FIG. 16. Freezing contents of the bottle causes the resilient member to expand from the retracted position to planar or expanded positions in which the resilient member is planar or outwardly convex. Resilient member 108 is thus configured to both seal the bottle and reversibly expand.

Resilient member 108 is thus selectively expandable inwards or outwards relative to top 76 of cap 74 so as to span a volume equal to or less than half the volume spanned by the cap in one example. The resilient member is therefore selectively expandable relative to the top of the cap so as to change the effective combined volume enclosed by the cap and the resilient member by anywhere in the range up of reduced by 50% thereof as seen in FIG. 10, to expanded by 50% thereof in one embodiment as seen in FIG. 16.

Removing cap 74 causes central portion 117 of resilient member 108 to move towards the planar position seen in FIG. 15 once more. Re-coupling the cap to bottle 60 while pre-loading the resilient member once more enables the resilient member to be outwardly concave once more as seen in FIG. 10. Cap 74 so re-coupled causes resilient 108 member so pre-loaded once more to remain outwardly concave regardless of whether the contents of bottle 60 are frozen or liquefied.

There is further provided a method of sealing a container, in this example the bottle. The method includes providing cap 74 with aperture 82 and resilient member 108 coupling to the cap and spanning the aperture. The method includes providing the resilient member to be elastic. Referring to FIG. 10, the method includes pre-loading central portion 117 of resilient member 108 by pushing downwards on the resilient member as shown by arrow 120. The method includes coupling cap 74 with the resilient member so pre-loaded, to bottle 60. The pre-loading step includes pre-loading resilient member 108 so as to create a reduced pressure within the bottle after the cap has been coupled to the bottle. The pre-loading step includes pre-loading the resilient member so as to cause the resilient member to be outwardly concave after cap 74 has been coupled to bottle 60.

Figure 17:
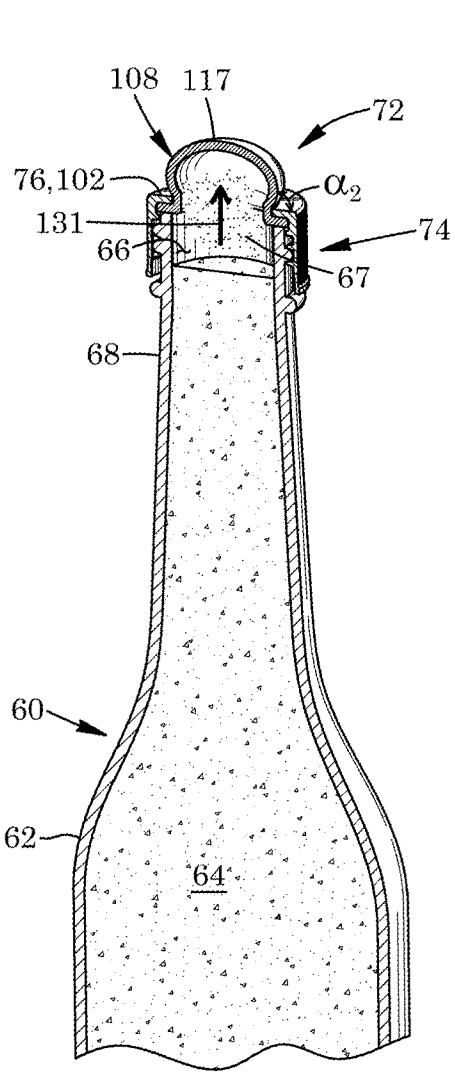
FIG. 17 is a front, top perspective sectional view of the cap assembly of FIG. 16, with the resilient member of the cap assembly being shown in a fully expanded position in which the resilient member is outwardly convex.

The method includes configuring resilient member 108 to be selectively expandable to accommodate changes in volume within the bottle as seen in FIGS. 15 and 16. The method includes configuring the resilient member to be selectively expandable to inhibit damage to the bottle when contents of the bottle freeze. The method includes configuring resilient member 108 to expand outwards from cap 74, as seen in FIGS. 16 and 17, when contents of the bottle freeze. The method includes configuring the resilient member to be selectively moveable towards an outwardly convex state.

FIGS. 22 to 34 shows a cap assembly 72.1 and container, in this example bottle 60.1 according to another aspect. Like parts have like numbers and functions as the cap assembly 72 and bottle 60 shown in FIGS. 1 to 21 with the addition of decimal extension ".1". Cap assembly 72.1 and bottle 60.1 are substantially the same as cap assembly 72 and bottle 60 shown in FIGS. 1 to 21 with at least the following exceptions.

Figure 22:
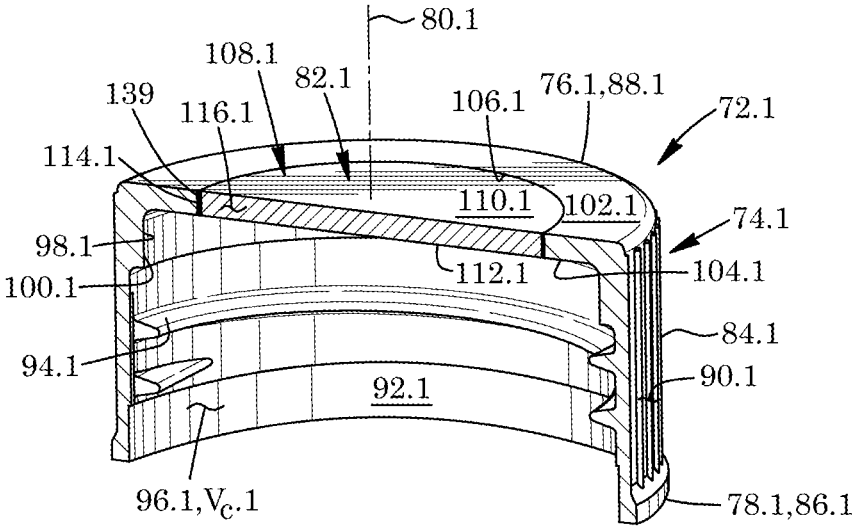
FIG. 22 is a front, top perspective sectional view similar to FIG. 5 of a cap assembly according to another aspect, with the cap assembly including a resilient member shown in a planar position.
Figure 23:
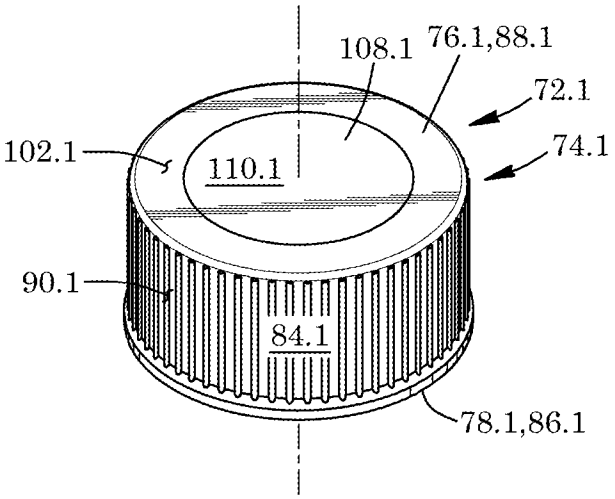
FIG. 23 is a top, front perspective view thereof.
Figure 24:
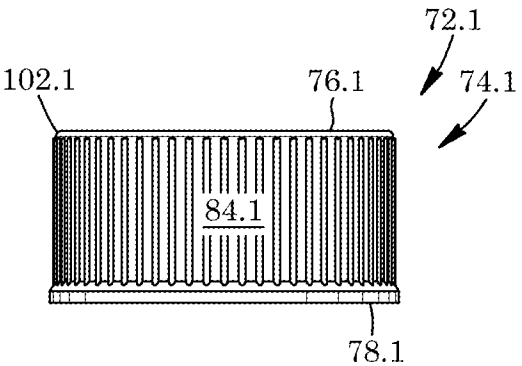
FIG. 24 is a front elevation view thereof, with the rear elevation view of the cap assembly being a mirror image thereof.
Figure 25:
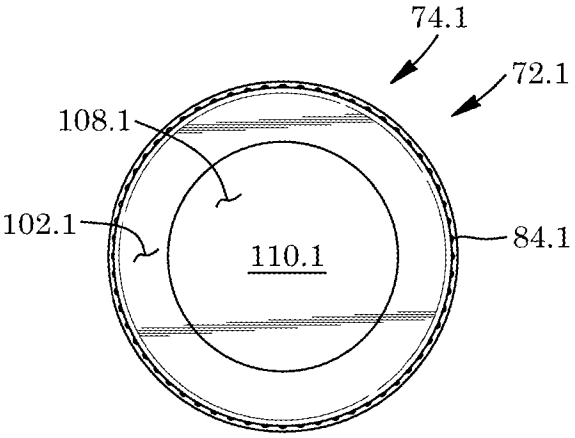
FIG. 25 is a top plan view thereof.
Figure 26:
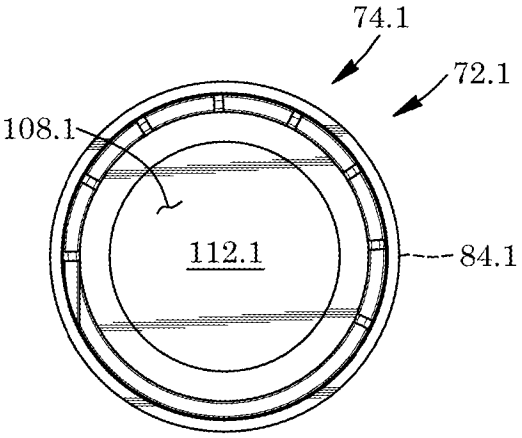
FIG. 26 is a bottom plan view thereof.
Figure 28:
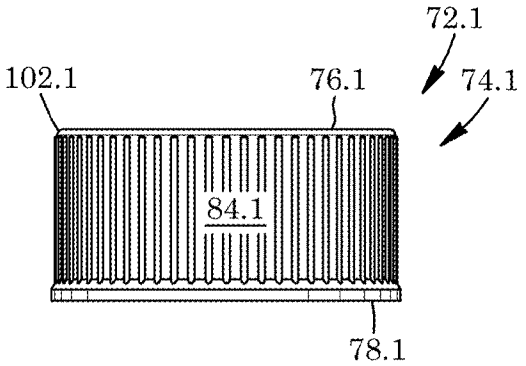
FIG. 28 is a front elevation view thereof, with the rear elevation view of the cap assembly being a mirror image thereof.
Figure 27:
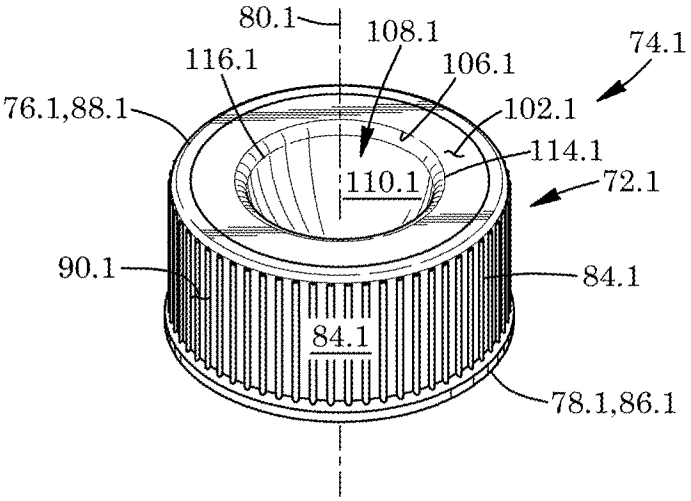
FIG. 27 is a front, top perspective view of the cap assembly of FIG. 22 with the resilient member thereof shown pre-loaded and in the retracted position.
Figure 30:
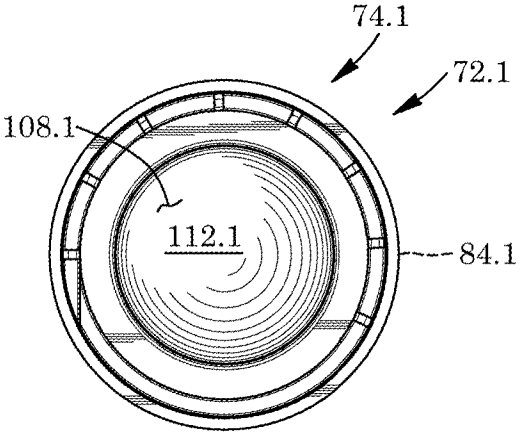
FIG. 30 is a bottom plan view thereof.
Figure 29:
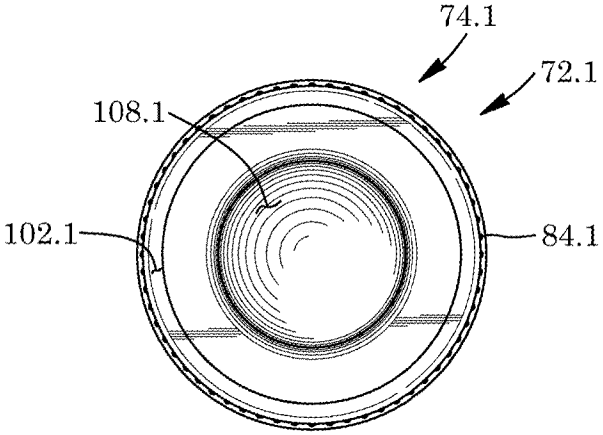
FIG. 29 is a top plan view thereof.
Figure 32:
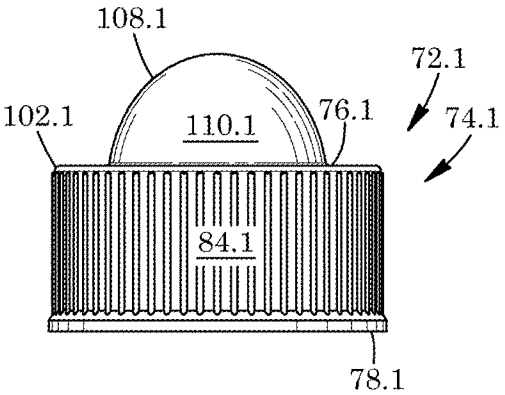
FIG. 32 is a front elevation view thereof, with the rear elevation view of the cap assembly being a mirror image thereof.
Figure 31:
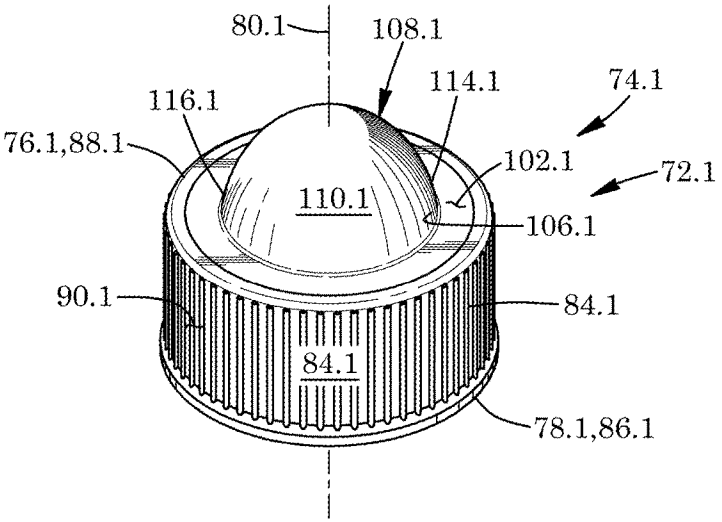
FIG. 31 is a front, top perspective view of the cap assembly of FIG. 22 with the resilient member thereof shown in an expanded position in which the resilient member is outwardly convex.
Figure 34:
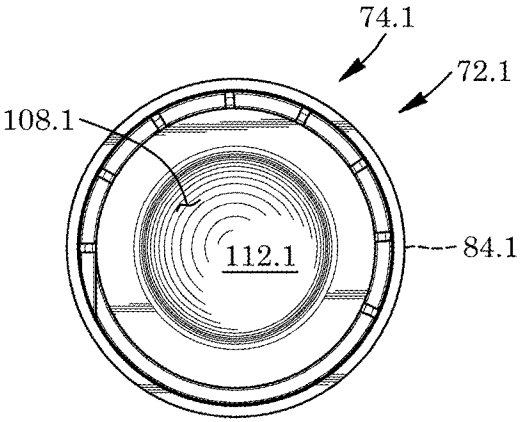
FIG. 34 is a bottom plan view thereof.
Figure 33:
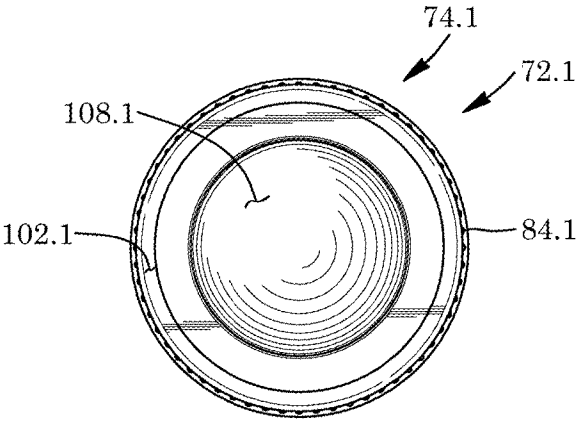
FIG. 33 is a top plan view thereof.

As seen in FIG. 22, inner edge portion 106.1 of flange 102.1 of cap 74.1 couples to outer edge portion 114.1 of resilient member 108.1 in this embodiment. In this example the flange and resilient member bond and/or are molded together via said edge portions. Resilient member is flush with flange 102.1 and top 76.1 of cap 74.1 in this example.

It will be appreciated that many variations are possible within the scope of the invention described herein. Where a component (e.g. a assembly, device etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

In some embodiments, the invention may be implemented in software. For greater clarity, "software" includes any instructions executed on a processor, and may include (but is not limited to) firmware, resident software, microcode, code for configuring a configurable logic circuit, applications, apps, and the like. Both processing hardware and software may be centralized or distributed (or a combination thereof), in whole or in part, as known to those skilled in the art. For example, software and other modules may be accessible via local memory, via a network, via a browser or other application in a distributed computing context, or via other means suitable for the purposes described above.

Software and other modules may reside on servers, workstations, personal computers, tablet computers, and other devices suitable for the purposes described herein.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms. These terms ("a", "an", and "the") mean one or more unless stated otherwise;

"and/or" is used to indicate one or both stated cases may occur, for example A and/or B includes both (A and B) and (A or B);

"approximately" when applied to a numerical value means the numerical value±10%;

where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and "first" and "second" are used for descriptive purposes and cannot be understood as indicating or implying relative importance or indicating the number of indicated technical features.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

in some embodiments the numerical value is 10;

in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

in some embodiments the numerical value is in the range of C to D where C and D are respectively lower and upper endpoints of the range that encompasses all of those values that provide a substantial equivalent to the value 10

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternatives or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

ADDITIONAL DESCRIPTION

Examples of cap assemblies have been described. The following clauses are offered as further description.

(1) A cap assembly for a container, the assembly comprising: a cap shaped to selectively couple to a container, the cap having an aperture extending through a top thereof; and a resilient member coupled to and spanning the aperture of the cap, the resilient member being configured to both seal the container and reversibly expand.

(2) A cap assembly according to clause 1, or any preceding clause or subsequent clause, wherein the resilient member is continuous and shaped to inhibit fluid from passing therethrough.

(3) A cap assembly according to any one of clauses 1 to 2, or any preceding clause or subsequent clause, wherein the resilient member is planar.

(4) A cap assembly according to any one of clauses 1 to 3, or any preceding clause or subsequent clause, wherein the resilient member has an expanded position in which the resilient member is outwardly convex.

(5) A cap assembly according to any one of clauses 1 to 4, or any preceding clause or subsequent clause, wherein the resilient member has a retracted position in which the resilient member is outwardly concave.

(6) A cap assembly according to any one of clauses 1 to 5, or any preceding clause or subsequent clause, wherein the cap has a bottom and a top spaced-apart from the bottom thereof, and wherein the resilient member is positioned between the top and the bottom of the cap in a non-stretched/non-expanded state.

(7) A cap assembly according to any one of clauses 1 to 6, or any preceding clause or subsequent clause, wherein the resilient member is flush with the top of the cap in a non-stretched/non-expanded state.

(8) A cap assembly according to any one of clauses 1 to 6, or any preceding clause or subsequent clause, wherein the resilient member is inwardly spaced from the top of the cap in a non-stretched/non-expanded state.

(9) A cap assembly according to any one of clauses 1 to 6, or any preceding clause or subsequent clause, wherein the resilient member extends towards the bottom of the cap in a non-stretched/non-expanded state.

(10) A cap assembly according to any one of clauses 1 to 6, or any preceding clause or subsequent clause, wherein the cap is shaped to inhibit puncturing of the resilient member when the resilient member is in a non-stretched/non-expanded state.

(11) A cap assembly according to any one of clauses 1 to 10, or any preceding clause or subsequent clause, wherein the resilient member has an outer peripheral portion to which the cap couples.

(12) A cap assembly according to any one of clauses 1 to 11, or any preceding clause or subsequent clause, wherein the cap extends about and encloses the outer peripheral portion of the resilient member.

(13) A cap assembly according to any one of clauses 1 to 12, or any preceding clause or subsequent clause, wherein the cap extends about and encloses the sides and top of the outer peripheral portion of the resilient member

(14) A cap assembly according to any one of clauses 1 to 13, or any preceding clause or subsequent clause, wherein the cap includes an annular flange which overlaps with and couples to the outer peripheral portion of the resilient member.

(15) A cap assembly according to any one of clauses 1 to 14, or any preceding clause or subsequent clause, wherein the cap includes an annular flange with an interior surface to which the outer peripheral portion of the resilient member couples.

(16) A cap assembly according to any one of clauses 1 to 13, or any preceding clause or subsequent clause, wherein the cap includes an annular flange with an inner edge portion to which an outer edge portion of the resilient member couples.

(17) A cap assembly according to any one of clauses 1 to 16, or any preceding clause or subsequent clause, wherein the cap is shaped to inhibit the resilient member from expanding radially outwards while enabling the resilient member to expand axially.

(18) A cap assembly according to any one of clauses 1 to 16, or any preceding clause or subsequent clause, wherein the cap is shaped to bias the resilient member against the container to promote sealing thereof.

(19) A cap assembly according to any one of clauses 1 to 18, or any preceding clause or subsequent clause, wherein the outer peripheral portion of the resilient member is planar and shaped to extend along an outer rim of a container.

(20) A cap assembly according to any one of clauses 1 to 19, or any preceding clause or subsequent clause, wherein the annular flange of the cap is shaped to bias the outer peripheral portion of the resilient member against the outer rim of a container.

(21) A cap assembly according to any one of clauses 1 to 20, or any preceding clause or subsequent clause, wherein the resilient member is configured to be preloaded while the cap couples to the container to reduce the amount of air within the container.

(22) A cap assembly according to clause 21, or any preceding clause or subsequent clause, wherein the resilient member is outwardly concave in the preloaded state.

(23) A cap assembly according to any one of clauses 1 to 22, or any preceding clause or subsequent clause, wherein the resilient member is configured to be inwardly biased towards the bottom of the cap while couples to the container to reduce the amount of air within the container.

(24) A cap assembly according to any one of clauses 1 to 23, or any preceding clause or subsequent clause, wherein the resilient member is shaped to expand upon contents within the container freezing.

(25) A cap assembly according to any one of clauses 1 to 24, or any preceding clause or subsequent clause, wherein the resilient member is shaped to accommodate an expansion of volume within the container arising from the freezing of liquid within the container.

(26) A cap assembly according to any one of clauses 1 to 25, or any preceding clause or subsequent clause, wherein the resilient member is an elastomeric material.

(27) A cap assembly according to any one of clauses 1 to 26, or any preceding clause or subsequent clause, wherein the resilient member is elastic.

(28) A cap assembly according to any one of clauses 1 to 27, or any preceding clause or subsequent clause, wherein the cap is rigid or semi-rigid.

(29) A cap assembly according to any one of clauses 1 to 28, or any preceding clause or subsequent clause, wherein the resilient member is more flexible than the cap.

(30) A cap assembly according to any one of clauses 1 to 29, or any preceding clause or subsequent clause, wherein the cap includes a radially-inwardly facing passageway shaped to receive the outer peripheral portion of the resilient member.

(31) A container sealing assembly comprising: a housing having an aperture extending through; and a resilient member coupled to and spanning the aperture of the housing, the resilient member having a pre-loaded state in which the resilient member is outwardly concave and the resilient member being moveable from the pre-loaded state to an expanded state in which the resilient member is planar or outwardly convex.

(32) A cap assembly for a container, the assembly comprising: a cap shaped to selectively couple to a container, the cap having an aperture extending through a top thereof; and a resilient member coupled to and spanning the aperture of the cap, the resilient member having a pre-loaded state in which the resilient member is outwardly concave and the resilient member being moveable from the pre-loaded state to an expanded state in which the resilient member is planar or outwardly convex.

(33) A cap assembly for a container, the assembly comprising: a cap shaped to selectively couple to a container, the cap having a top and an aperture extending through the top thereof; and a resilient member coupled to the top and spanning the aperture of the cap, the resilient member having a pre-loaded retracted position in which the resilient member extends inwards relative to the top of the cap by an angle equal to or greater than 0 degrees and equal to or less than 90 degrees relative to the top of the cap.

(34) A cap assembly for a container, the assembly comprising: a cap shaped to selectively couple to a container, the cap having a top and an aperture extending through the top thereof; and a resilient member coupled to the top and spanning the aperture of the cap, the resilient member having an expanded position in which the resilient member extends outwards relative to the top of the cap by an angle equal to or greater than 0 degrees and equal to or less than 180 degrees relative to the top of the cap.

(35) A cap assembly for a container, the assembly comprising: a cap shaped to selectively couple to a container, the cap having a top and an aperture extending through the top thereof; and a resilient member coupled to the top and spanning the aperture of the cap, the resilient member having a pre-loaded retracted position in which the resilient member extends inwards relative to the top of the cap by an angle equal to or greater than 0 degrees and equal to or less than 90 degrees relative to the top of the cap, the resilient member being movable from the retracted position to an expanded position in which the resilient member extends outwards relative to the top of the cap by an angle equal to or greater than 0 degrees and equal to or less than 180 degrees relative to the top of the cap.

(36) A cap assembly according to any one of clauses 33 to 35, or any preceding or subsequent clause herein, wherein said angle is acute.

(37) A cap assembly according to any one of clauses 33 to 35, or any preceding or subsequent clause herein, wherein said angle is obtuse.

(38) A cap assembly for a container, the assembly comprising: a cap shaped to selectively couple to a container, the cap spanning a volume and having an aperture extending through a top thereof; and a resilient member coupled to and spanning the aperture of the cap, the resilient member being selectively expandable inwards or outwards relative to the top of the cap so as to span a volume equal to or less than half the volume spanned by the cap.

(39) A cap assembly for a container, the assembly comprising: a cap shaped to selectively couple to a container, the cap having an aperture extending through a top thereof; and a resilient member coupled to and spanning the aperture of the cap, the resilient member being selectively retractable inwards relative to the top of the cap so as to reduce the effective combined volume enclosed by the cap and the resilient member by up to 50% thereof

(40) A cap assembly for a container, the assembly comprising: a cap shaped to selectively couple to a container, the cap having an aperture extending through a top thereof; and a resilient member coupled to and spanning the aperture of the cap, the resilient member being selectively extendable outwards relative to the top of the cap so as to expand the effective combined volume enclosed by the cap and the resilient member by up to 50% thereof

(41) A cap assembly for a container, the assembly comprising: a cap shaped to selectively couple to a container, the cap spanning a volume and having an aperture extending through a top thereof; and a resilient member coupled to and spanning the aperture of the cap, the resilient member being selectively expandable relative to the top of the cap so as to change the effective combined volume enclosed by the cap and the resilient member by anywhere in the range up of reduced by 50% thereof to expanded by 50% thereof.

(42) A cap assembly for a container, the cap assembly comprising: a cap having an open-top; and a sealing member coupled to and spanning the open-top of the cap, the cap functioning to bias an outer peripheral portion of the resilient member downwards or against the container while enabling a central portion of the resilient member to reversibly stretch inwards and outwards relative to the open-top of the cap.

(43) A cap assembly according to any one of clauses 1 to 42, or any preceding or subsequent clause, wherein the resilient member is bulbous in the expanded position thereof.

(44) A cap assembly according to any one of clauses 1 to 42, or any preceding or subsequent clause, wherein the resilient member is bulbous in the retracted position thereof.

(45) A cap assembly for a container, the assembly comprising: a cap shaped to selectively couple to a container; and a resilient member coupled to the cap, the cap being shaped to exert a clamping force about an outer peripheral portion of the resilient member in a first direction to bias the outer peripheral portion of the resilient member against an outer rim of the container, and the cap being shaped to enable a central portion of the resilient member to selectively expand in the first direction or a second direction opposite the first direction, upon one or more forces acting upon the resilient member.

(46) A cap assembly for a container according to any one of clauses 1 to 45, or any preceding or subsequent clause herein, wherein the resilient member is stretchable.

(47) A container comprising: a hollow body with an open top; a cap shaped to selectively couple to the open top of the body, the cap having an aperture extending therethrough; and a resilient member coupled to and spanning the aperture of the cap, the resilient member being pre-loaded to a retracted position in which the resilient member is outwardly concave when the cap couples to the hollow body, whereby freezing contents of the container causes the resilient member to expand from the retracted position to a planar or expanded position in which the resilient member is planar or outwardly convex, whereby removing the cap causes the resilient member to move towards the planar position, and whereby re-coupling the cap to the body while pre-loading the resilient member once more enables the resilient member to be outwardly concave once more.

(48) A container according to clause 47, or any preceding or subsequent clause, wherein the cap so re-coupled with the resilient member pre-loaded once more remains outwardly concave regardless of whether the contents of the container are frozen or liquefied.

(49) A container comprising a cap assembly according to any one of clauses 1 to 47 or any preceding clause or subsequent clause.

(50) A method of sealing a container, the method comprising: providing a cap with an aperture and a resilient member coupling to the cap and spanning the aperture; pre-loading the resilient member by pushing downwards on the resilient member; and coupling the cap with the resilient member so pre-loaded, to the container.

(51) A method of sealing a container according to clause 50, or any preceding clause or subsequent clause, including pre-loading the resilient member so as to create a reduced pressure within the container after the cap has been coupled to the container.

(52) A method of sealing a container according to any one of clauses 50 to 51, or any preceding clause or subsequent clause, including pre-loading the resilient member so as to cause the resilient member to be outwardly concave after the cap has been coupled to the container.

(53) A method of sealing a container according to any one of clauses 50 to 52, or any preceding clause or subsequent clause, including configuring the resilient member to be selectively expandable to accommodate changes in volume within the container.

(54) A method of sealing a container according to any one of clauses 50 to 53, or any preceding clause or subsequent clause, including configuring the resilient member to be selectively expandable to inhibit damage to the container when contents of the container freeze.

(55) A method of sealing a container according to any one of clauses 50 to 54, or any preceding clause or subsequent clause, including configuring the resilient member to expand outwards from the cap when contents of the container freeze.

(56) A method of sealing a container according to any one of clauses 50 to 55, or any preceding clause or subsequent clause, including configuring the resilient member to be selectively moveable towards an outwardly convex state.

(57) A method of sealing a container according to any one of clauses 50 to 56, or any preceding clause or subsequent clause, including providing the resilient member to be elastic.

(58) An apparatus for sealing a container, the apparatus comprising: a gripping member shaped to selectively couple to a cap, the gripping member including a protrusion shaped to bias a top of the cap towards a bottom of the cap; and an actuator which selectively rotates one of the gripping member and a container, the actuator so configured functioning to cause the cap so gripped to threadably couple to the container.

(59) An apparatus for sealing a container according to clause 58, or any subsequent or preceding clause, wherein the top of the cap is resilient.

(60) An apparatus for sealing a container according to any one of clauses 58 to 59, or any subsequent or preceding clause, wherein the gripping member is shaped to pre-load the cap such that pressure within the container is reduced after the cap so couples to the container.

(61) An apparatus for sealing a container according to any one of clauses 58 to 60, or any subsequent or preceding clause, wherein the gripping member is shaped to cause the top of the cap to be outwardly concave after the cap so couples to the container.

(62) A method of manufacturing of a liquid-filled and sealed container, the method comprising: providing a container with an opening; at least partially filling the container with a liquid via the opening; forming a cap with an aperture extending through a top therethrough; coupling a resilient member to the cap so as to span across or adjacent to the aperture of the cap; depressing the resilient member inwards; and coupling the cap with the resilient member so depressed, to the container so as to seal the opening of the container via the resilient member.

(63) A method of manufacturing according to clause 62, or any precedent or subsequent clause, including within the depressing step, pre-loading the resilient member.

(64) A method of manufacturing according to any one of clauses 62 to 63, or any precedent or subsequent clause, including configuring the resilient member to stretch to accommodate an expansion of volume within the container arising from freezing of liquid within the container.

(65) A method of manufacturing according to any one of clauses 62 to 64, or any precedent or subsequent clause, wherein the resilient member so depressed and sealed to the container is outwardly concave.

(66) A method of manufacturing according to any one of clauses 62 to 65, or any precedent or subsequent clause, including shaping the resilient member to move towards a planar position in response freezing of the liquid within the container.

(67) A method of manufacturing according to any one of clauses 62 to 66, or any precedent or subsequent clause, including shaping the resilient member to expand outwards from the top of the cap in response to freezing of the liquid within the container.

(68) A method of manufacturing according to any one of clauses 62 to 67, or any precedent or subsequent clause, including shaping the resilient member to move to an expanded position that is outwardly convex in shape in response to freezing of the liquid within the container.

(69) A method of manufacturing according to any one of clauses 62 to 68, or any precedent or subsequent clause, including configuring the resilient member to one or more of: inhibit an increase in internal pressure within the container as the liquid within the container freezes; and reduce the internal pressure within the container as the liquid within the container freezes.

(70) A method of manufacturing according to any one of clauses 62 to 69, or any precedent or subsequent clause, including reducing pressure within the container by depressing the resilient member and thereafter coupling the cap to the opening of the container.

(71) A method of manufacturing according to any one of clauses 62 to 70, or any precedent or subsequent clause, including reducing the amount of excess gas within the container by depressing the resilient member inwards and thereafter coupling the cap to the opening of the container.

(72) A method of manufacturing according to any one of clauses 62 to 71, or any precedent or subsequent clause, including sealing the container by shaping the cap to bias an outer peripheral portion of the resilient member against an outer rim of the container.

(73) A method of manufacturing according to any one of clauses 62 to 72, or any precedent or subsequent clause, including sealing the container by forming the cap to include an annular flange and threadably coupling the cap to the container so as to clamp an outer peripheral portion of the resilient member between the flange and an outer rim of the container.

(74) A method of manufacturing according to any one of clauses 62 to 73, or any precedent or subsequent clause, including configuring the resilient member to be retractable inwards relative to the top of the cap so as to reduce the effective combined volume enclosed by the cap and the resilient member by up to 50% thereof.

(75) A method of manufacturing according to any one of clauses 62 to 74, or any precedent or subsequent clause, including configuring the resilient member to be selectively extendable outwards relative to the top of the cap so as to expand the effective combined volume enclosed by the cap and the resilient member by up to 50% thereof.

(76) A method of manufacturing according to any one of clauses 62 to 75, or any precedent or subsequent clause, including configuring the resilient member to be outwardly bulbous in the expanded position thereof.

(77) A method of manufacturing according to any one of clauses 62 to 76, or any precedent or subsequent clause, including configuring the resilient member to be inwardly bulbous in the depressed position thereof.

(78) A method of manufacturing according to any one of clauses 62 to 77, or any precedent or subsequent clause, including configuring the resilient member to be selectively expandable outwards relative to the top of the cap by an angle equal to or greater than 0 degrees and equal to or less than 180 degrees relative to the top.

(79) A method of manufacturing according to any one of clauses 62 to 78, or any precedent or subsequent clause, including configuring the resilient member to extends inwards relative to the top of the cap by an angle equal to or greater than 0 degrees and equal to or less than 90 degrees relative to the top of the cap.

(80) A method of manufacturing according to any one of clauses 78 to 79, or any precedent or subsequent clause, wherein said angle is acute.

(81) A method of manufacturing according to clause 78, or any precedent or subsequent clause, wherein said angle is obtuse.\

(82) A method of manufacturing of a liquid-filled and sealed container, the method comprising: providing a container with an opening; at least partially filling the container with a liquid via the opening; positioning a resilient member to span across or adjacent to the aperture of the container; depressing the resilient member inwards; and coupling the resilient member so depressed, to the container so as to seal the opening of the container via the resilient member.

(83) A method of manufacturing according to clause 82, or any precedent or subsequent clause, including within the coupling step, coupling an outer peripheral portion of the resilient member against the container.

(84) A method of manufacturing according to any one of clauses 82 to 83, or any precedent or subsequent clause, including within the coupling step, clamping the outer peripheral portion of the resilient member against the container.

(85) A method of manufacturing according to any one of clauses 82 to 84, or any precedent or subsequent clause, including configuring the resilient member to be selectively removable from and re-connectable to the container.

(86) Apparatus including any new and inventive feature, combination of features, or sub-combination of features as described herein.

(87) Methods including any new and inventive steps, acts, combination of steps and/or acts or sub-combination of steps and/or acts as described herein.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A cap assembly for a bottle, the cap assembly comprising:

a cap shaped to selectively couple to the bottle, the cap having an aperture extending through a top thereof; and an elastomer coupled to and spanning the aperture of the cap, the elastomer sealing the bottle, being planar from an outer peripheral portion through to a central portion thereof, consisting of a single homogenous layer and being configured to reversibly expand.

2. The cap assembly according to claim 1, wherein the cap is shaped to inhibit the elastomer from expanding radially outwards while enabling the elastomer to expand axially.

3. The cap assembly according to claim 1, wherein the elastomer has a pre-loaded retracted position in which the elastomer extends inwards relative to the top of the cap by an angle equal to or greater than 0 degrees and equal to or less than 90 degrees relative to the top of the cap and wherein the elastomer has an expanded position in which the elastomer extends outwards from the top of the cap by an angle greater than 0 degrees and equal to or less than 180 degrees relative to the top of the cap.

4. The cap assembly according to claim 1, wherein the elastomer has a pre-loaded state in which the elastomer is outwardly concave and wherein the elastomer is moveable from the pre-loaded state to an expanded state in which the elastomer is planar.

5. The cap assembly according to claim 1, wherein the cap spans a volume and wherein the elastomer is selectively expandable inwards or outwards relative to the top of the cap so as to span a volume equal to or less than half the volume spanned by the cap.

6. The cap assembly according to claim 1, wherein the elastomer is moveable to an expanded state in which the elastomer is outwardly convex.

7. The cap assembly according to claim 1, wherein the cap includes a radially-inwardly facing passageway shaped to receive the outer peripheral portion of the elastomer.

8. The cap assembly according to claim 1, wherein the cap is configured to threadably couple to the bottle via threading and wherein the outer peripheral portion of the elastomer is adjacent and positioned in place via an upper thread of said threading.

9. The cap assembly according to claim 1, wherein the elastomer has an expanded position in which the central portion thereof extends outwards from the top of the cap.

10. The cap assembly according to claim 9, wherein the central portion of the elastomer in the expanded position thereof is upwards from the top of the cap.

11. The cap assembly according to claim 9, wherein the elastomer in the expanded position thereof extends outwards from the top of the cap by an angle greater than 0 degrees and equal to or less than 180 degrees relative to the top of the cap.

12. The cap assembly according to claim 9, wherein the central portion of the elastomer is selectively extendable upwards through the aperture and the top of the cap so as to expand the effective combined volume enclosed by the cap and the elastomer by up to 50% thereof.

13. The cap assembly according to claim 9, wherein the elastomer in the expanded position thereof extends outwards from the top of the cap by an angle greater than 90 degrees and less than 180 degrees relative to the top of the cap.

14. The cap assembly according to claim 9, wherein the elastomer in the expanded position thereof is bulbous.

15. The cap assembly according to claim 9, wherein the central portion of the elastomer in a retracted position thereof is between the top and bottom of the cap so as to inhibit puncturing thereof.

16. The cap assembly according to claim 9, wherein the central portion of the elastomer in a fully retracted position thereof is adjacent the bottom of the cap.

17. The cap assembly according to claim 9, wherein the elastomer substantially planar in a non-expanded state thereof.

18. The cap assembly according to claim 9, wherein the elastomer is made of an elastomeric material.

19. A bottle comprising:

a cap assembly including a cap and an elastomer, with the cap having an aperture extending through a top thereof, and with the elastomer coupling to and spanning the aperture of the cap, being planar from an outer peripheral portion through to a central portion thereof and consisting of a single homogenous layer; and a hollow body having an open top, with the cap of the cap assembly being shaped to selectively couple to the open top of the body so as to seal the bottle via the elastomer, with the elastomer so sealed being moveable axially upwards through the aperture in the cap in response to an increase in pressure within the bottle and being moveable axially downwards in response to a decrease in pressure within the bottle.

20. The cap assembly according to claim 8, wherein the upper thread of the threading of the cap positions the elastomer in place so as to inhibit movement of the outer peripheral portion of the elastomer.

* * * * *